US010427695B2

(12) United States Patent
Sutter et al.

(10) Patent No.: US 10,427,695 B2
(45) Date of Patent: Oct. 1, 2019

(54) DEVICE FOR REPLACING ROLLER SETS

(71) Applicant: INNOVA PATENT GMBH, Wolfurt (AT)

(72) Inventors: Josef Sutter, Bregenz (AT); Stefan Linder, Hohenems (AT); Harald Fischer, Wolfurt (AT)

(73) Assignee: Innova Patent GmbH, Wolfurt (AT)

( * ) Notice: Subject to any disclaimer, the term of this patent is extended or adjusted under 35 U.S.C. 154(b) by 602 days.

(21) Appl. No.: 14/903,613

(22) PCT Filed: Jun. 26, 2014

(86) PCT No.: PCT/AT2014/000133

§ 371 (c)(1),
(2) Date: Jan. 8, 2016

(87) PCT Pub. No.: WO2015/003196

PCT Pub. Date: Jan. 15, 2015

(65) Prior Publication Data

US 2016/0152244 A1 Jun. 2, 2016

(30) Foreign Application Priority Data

Jul. 11, 2013 (AT) ..... A 574/2013

(51) Int. Cl.

| | |
|---|---|
| ***B61B 12/12*** | (2006.01) |
| ***B61B 12/00*** | (2006.01) |
| ***B61B 7/00*** | (2006.01) |

(52) U.S. Cl.

CPC ..... *B61B 12/122* (2013.01); *B61B 7/00* (2013.01); *B61B 12/00* (2013.01)

(58) Field of Classification Search

CPC ..... B61B 12/02; B61B 7/00; B61B 12/00; B61B 12/127; B61B 7/02; B61B 7/06

See application file for complete search history.

(56) References Cited

U.S. PATENT DOCUMENTS

| | | | | |
|---|---|---|---|---|
| 2,243,664 | A * | 5/1941 | Baird | B66D 3/16 254/296 |
| 8,528,179 | B2 | 9/2013 | Kohler et al. | |
| 8,578,858 | B2 * | 11/2013 | Drogo | B61B 12/028 104/112 |
| 2008/0178760 | A1 * | 7/2008 | Frangos | B61B 13/00 104/112 |
| 2009/0050012 | A1 | 2/2009 | Coudurier et al. | |
| 2011/0067218 | A1 * | 3/2011 | Kohler | B61B 12/02 29/426.2 |
| 2012/0240812 | A1 | 9/2012 | Drogo et al. | |

FOREIGN PATENT DOCUMENTS

| | | |
|---|---|---|
| DE | 526484 C | 6/1931 |
| EP | 2301819 A2 | 3/2011 |

* cited by examiner

*Primary Examiner* — Jacob J Cigna
*Assistant Examiner* — Lee A Holly
(74) *Attorney, Agent, or Firm* — Laurence A. Greenberg; Werner H. Stemer; Ralph E. Locher

(57) ABSTRACT

A device replaces roller sets on pylons of cable cars. The device contains a replacing vehicle which can be moved along a cable of the cable car and at least two winches having cables by which the roller set to be replaced can be lowered and a new roller set can be raised. The replacing vehicle contains at least two interconnected vehicles which by way of clamps are connected to the cable.

14 Claims, 17 Drawing Sheets

DEVICE FOR REPLACING ROLLER SETS

BACKGROUND OF THE INVENTION

Field of the Invention

The invention relates to a device for replacing roller sets on pylons of cable cars comprising a replacing vehicle which can be moved along the cable of the cable car and comprising at least two winches with cables, by means of which a roller set to be replaced can be lowered and a new roller set raised.

The invention further relates to a method of replacing roller sets on pylons of cable car systems, in which a replacing vehicle is driven to the pylon and then a cable running on the roller set is raised from the roller set using the replacing vehicle and the roller set is subsequently removed.

A device of this kind and a method of this kind are known from EP 2 301 819 A. The disadvantage of the method described there, however, is that the old and new set sets have to be placed on the ground beneath the pylon, something that is not possible or is only possible with difficulty, for example, in heavily built-up urban areas, over water, on steep terrain, etc.

BRIEF SUMMARY OF THE INVENTION

The problem addressed by the invention is therefore that of creating a device and a method in which this is not necessary.

This problem is solved with a device of the kind referred to above, in that the replacing vehicle comprises at least two interconnected vehicles which are connected to the cable by way of grips.

This problem is solved with a method of the kind referred to above, in that in the case of the roller set suspended from the replacing vehicle, an assembly roller set is mounted on the pylon and the cable is placed onto the assembly roller set, the replacing vehicle is subsequently moved along the cable to another position and the roller set replaced with a new roller set, the new roller set is moved with the replacing vehicle to the pylon and the cable running on the assembly roller set is raised from the assembly roller set using the replacing vehicle and the assembly roller set is subsequently replaced with the roller set.

The at least two interconnected vehicles firstly provide the replacing vehicle with a high degree of stability and carrying capacity, which is advantageous particularly where large, heavy roller sets are concerned, and secondly create sufficient space either for a new roller set to be mounted on the pylon or an assembly roller set temporarily mounted when the old roller set is removed and suspended from the replacing vehicle, so that the old roller set can be deposited at a suitable place and a new roller set taken up and mounted.

It is therefore particularly preferable in the invention for the device according to the invention to comprise four interconnected vehicles, wherein the winches are arranged on the two outer vehicles and cable pulleys for the cables are arranged on the two inner vehicles.

Further preferred embodiments of the invention are the subject-matter of the remaining dependent claims.

Further features and advantages of the invention emerge from the following description of a preferred exemplary embodiment of the invention with reference to the attached drawings.

DESCRIPTION OF THE INVENTION

Figure 1:
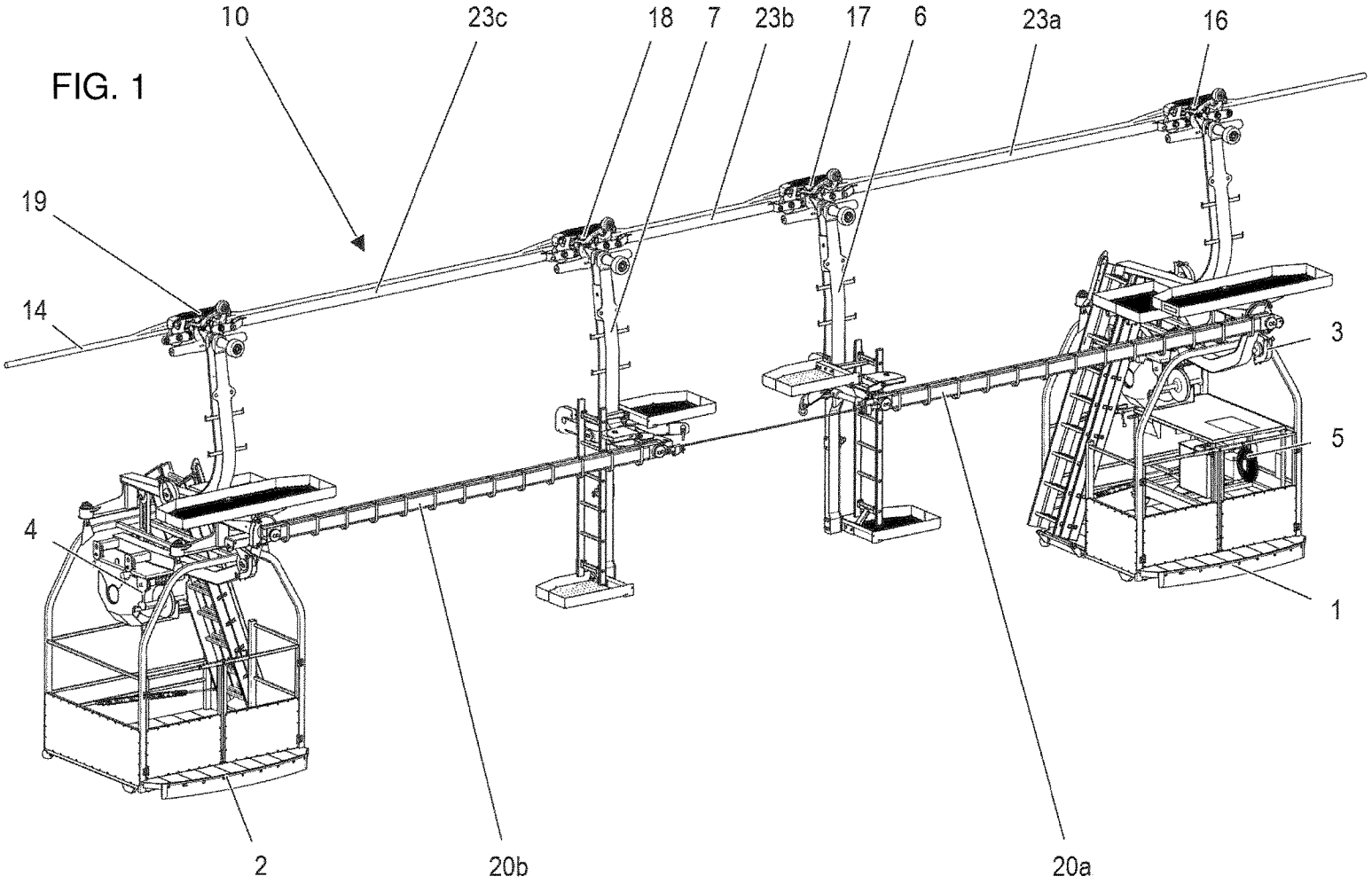
FIG. 1 shows a preferred embodiment of the invention.

The replacing vehicle 10 according to the invention is a vehicle group comprising four individual vehicles in the embodiment shown. The first and last vehicles 1, 2 have the outer dimensions of a standard maintenance vehicle. Hydraulic cable winches 3, 4 are secured in these vehicles 1. A hydraulic unit 5 with a diesel engine is, in addition, disposed in one of the vehicles. The hydraulic cable winch 4 in the vehicle 2 in which the hydraulic unit 5 is located is supplied via a hydraulic line which is laid along or through connection rods 23*a*, 23*b*, 23*c*, for example.

The two center vehicles 6, 7 are suspension units configured as simply as possible, by means of which the load of the roller set 15 being replaced is supported. Cables 8, 9 of the two cable winches 3, 4 are either laid within the vehicle group, i.e. from the outer vehicles 1, 2 straight to the center vehicles 5, 6 or via deflection rollers to the pylon 13. In order to absorb the internal forces, the vehicles 1, 2, 6, 7 or else the grips 16, 17, 18, 19 thereof, are connected in an articulated fashion via connection rods 23*a*, 23*b*, 23*c*.

The replacement of a roller set 15 is explained below in a preferred variant of the invention on a preferred embodiment of the invention.

The individual vehicles 1, 2, 6, 7 are stored at the cable car terminal when they are not needed or brought to the cable car when they are required. To deploy the replacing vehicle 10, the individual vehicles 1, 2, 6, 7 must be introduced, e.g. in a straight section of the terminal exit (on the mountain or valley cable, depending on the application). The four individual vehicles 1, 2, 6, 7 are connected in the straight section by means of the connection rods 23*a*, 23*b*, 23*c* in the region of the grips 16, 17, 18, 19, which are preferably configured as conventional grips, and each standard maintenance vehicle 1, 2 is connected by means of connection rods 20*a*, 20*b* in the region of the upper edge of the basket to a suspension unit 6, 7. The cable winches 3, 4 and the hydraulic unit 5 are installed in the winch vehicles when required and the lines and winch cables 8, 9 are laid within the vehicle group. In order to ensure that the winch cables 8, 9 are cleanly removed from the winches 3, 4 later, weights (e.g. 20-30 kg in each case) must be secured to the ends of the winch cables 8, 9. Only one coupling grip 16 of the four coupling grips 16, 17, 18, 19 (those which leave the terminal first) must be fitted with a friction lining. This couples onto the conveying cable 14 and pulls the other three vehicles 2, 6, 7 until all four are coupled on.

The suspension units 6, 7 each comprise a swivel carrier 23 and a hinged carrier 24. The swivel carrier 23 can be pivoted about a vertical axis 25 in a horizontal direction and exhibits at its end a load hook, an eye 30 or the like. The hinged carrier 24 can be pivoted about a horizontal axis 26 in a vertical direction and has a cable pulley 27 at its end.

Figure 2:
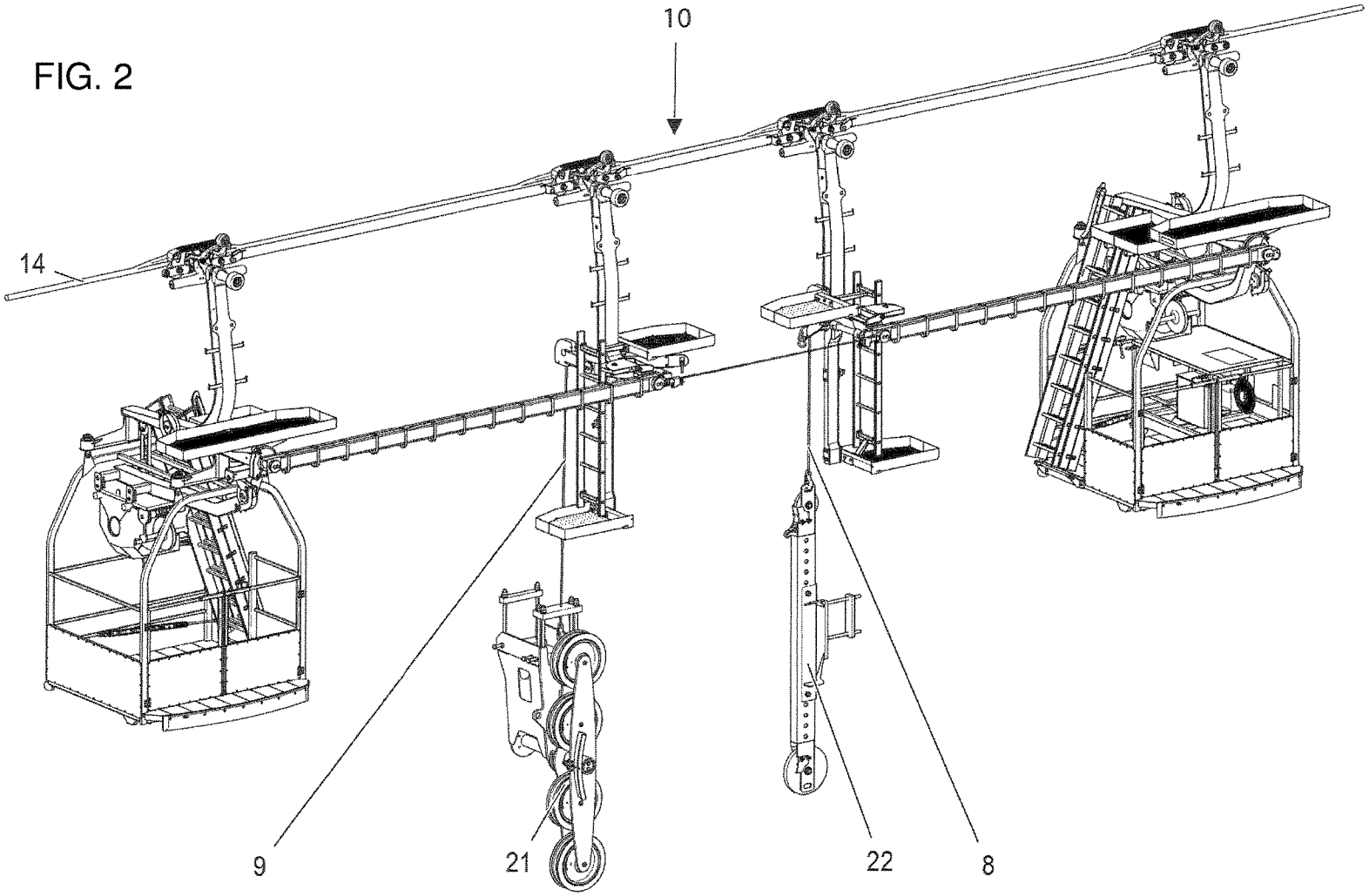
FIGS. 2 to 17 show the processes involved in replacing an old roller set with a new one.

At a point below the cable car at which access is possible using a lorry, an assembly roller set 21 and an assembly carrier 22 are initially added. This involves the replacing vehicle 10 moving along the cable way above the lorry or the storage site and lifting up the assembly roller set 21 and the assembly carrier 22 with the cables 8, 9 which run via the cable pulleys 27 on the hinged carriers 24 of the suspension units 6, 7. The assembly roller set 21 and the assembly carrier 22 are pulled up, as shown in FIG. 2, until they are suspended within the customary free space of the standard vehicles.

Figure 3:
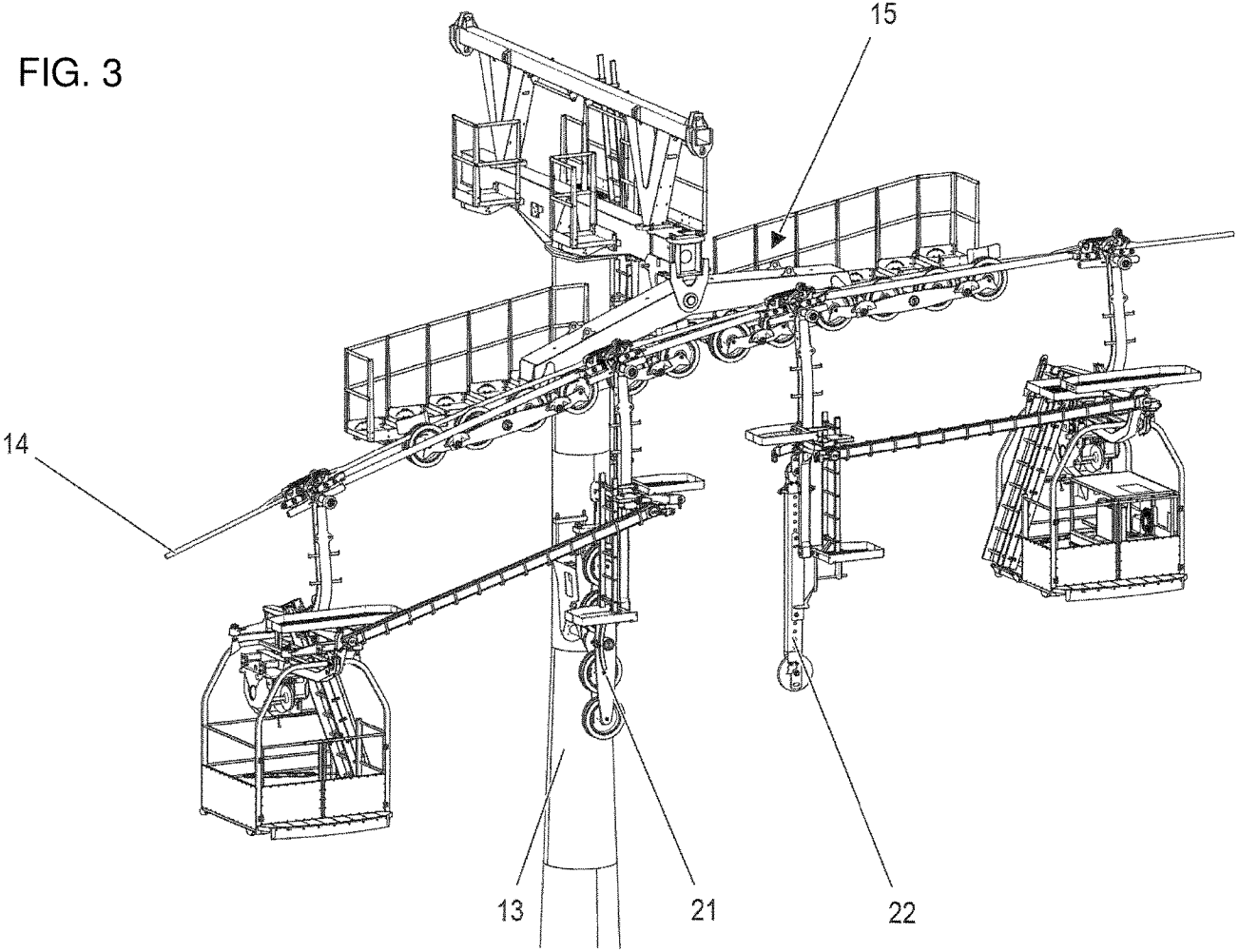
Figure 4:
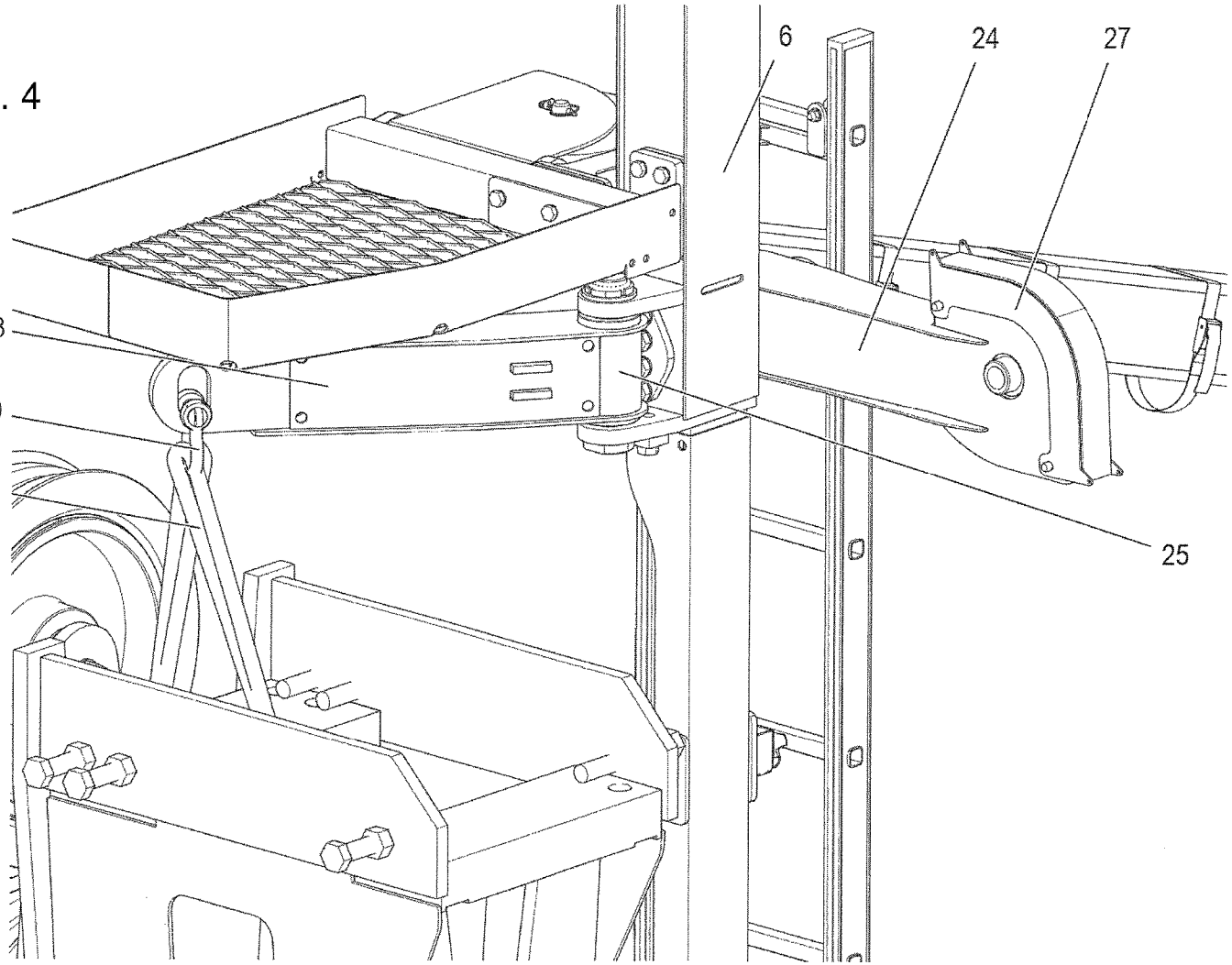

Using the customary cable car drive, the replacing vehicle 10 travels with the assembly roller set 21 and the assembly carrier 22 to the pylon 13 concerned (FIG. 3). The assembly roller set 21 and the assembly carrier 22 are then transferred with the help of the cables 8, 9 and by means of fixed round slings 28 from the hinged carriers 24 to the swivel carriers 23, so that the cables 8, 9 are free (FIG. 4). The assembly roller set is then pivoted away, e.g. by means of a hydraulic cylinder.

Figure 5:
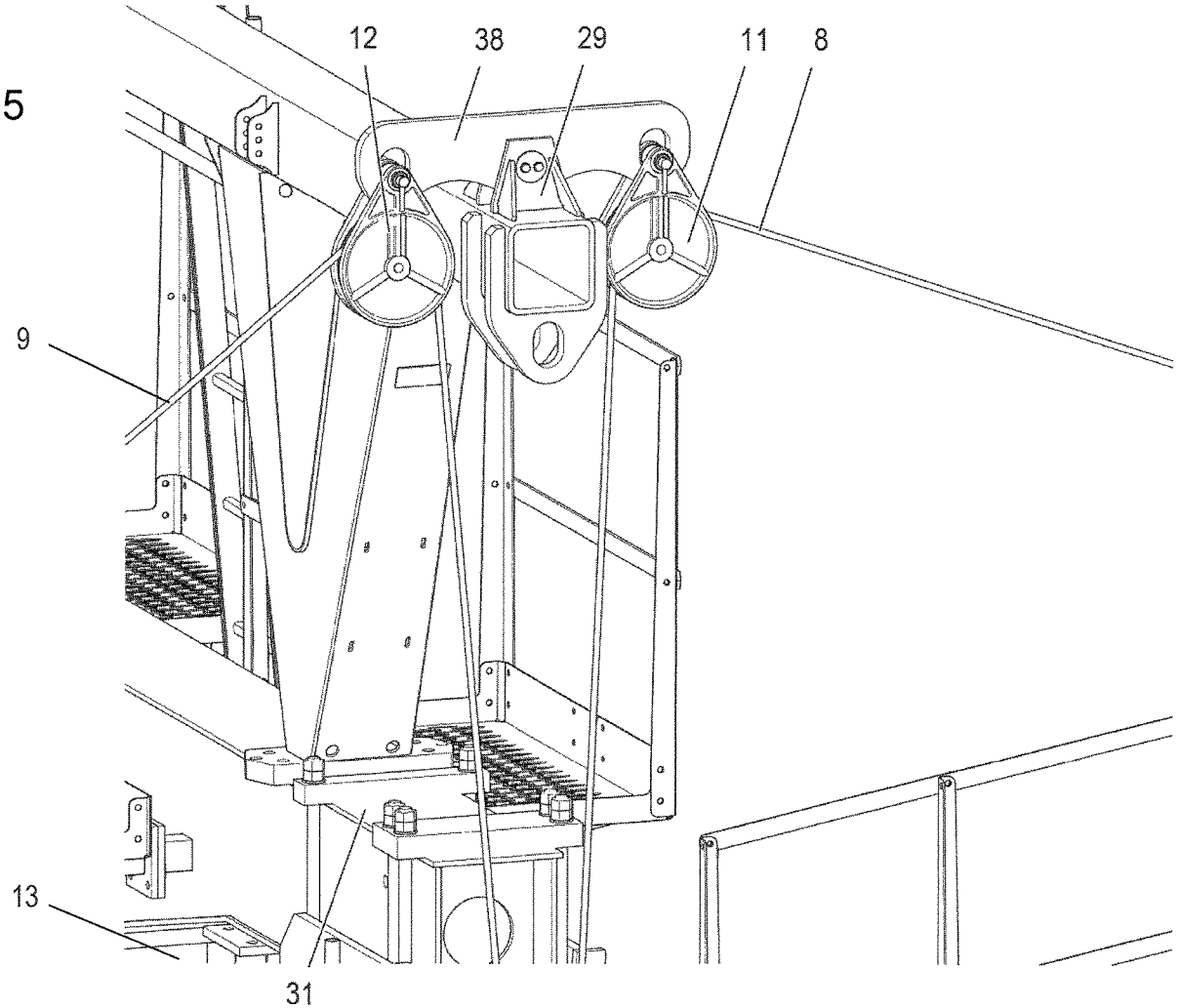
Figure 6:
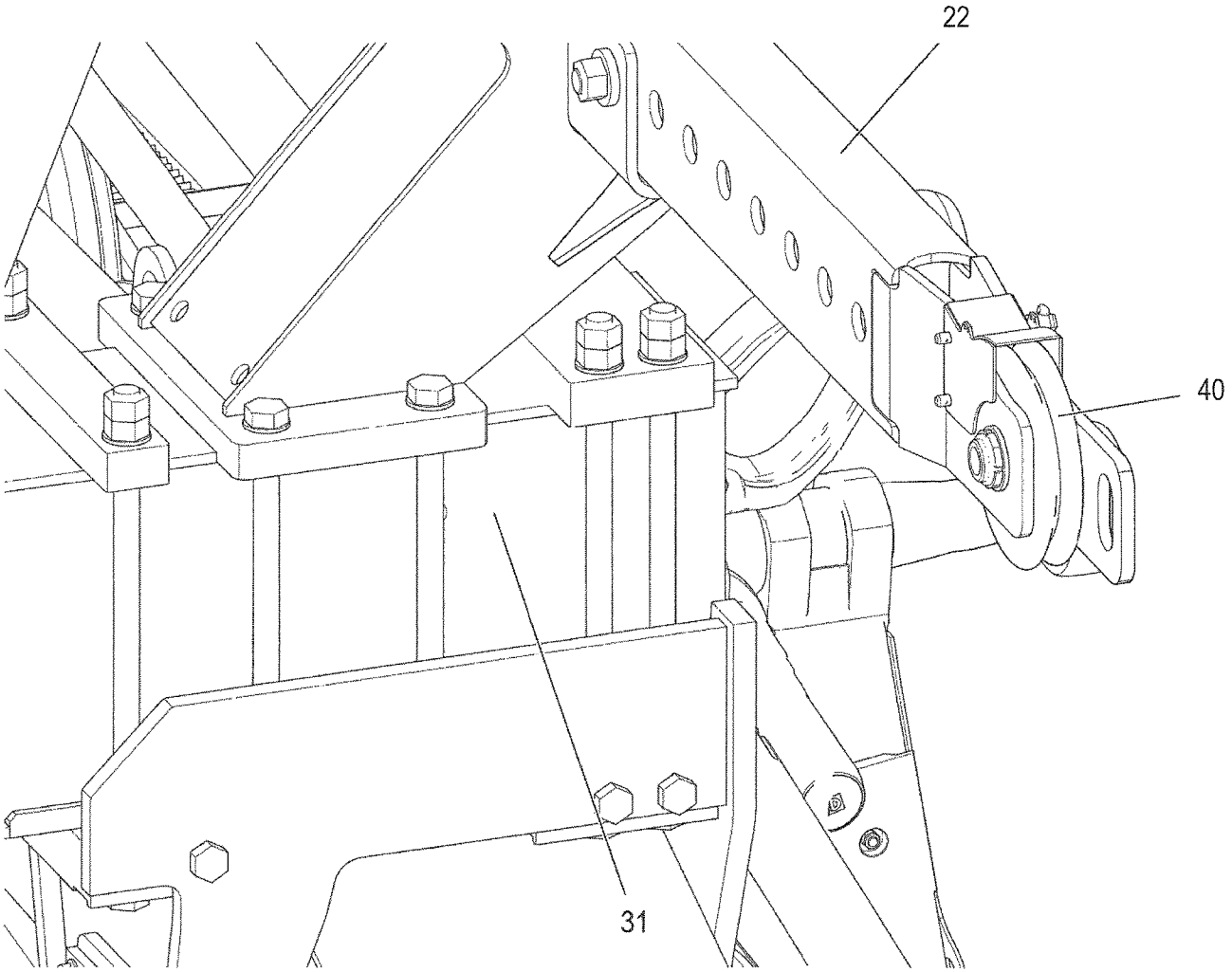

The cables 8, 9 are then arranged over deflection rollers which are arranged on the rear side of the coupling grips 16, 19 in the drawings, as shown in FIG. 5, and two deflection rollers 11, 12 are placed on a mounting 29 on the pylon 13, in order to be used to pull up the assembly carrier 22 and to position and screw it to a cross-head 31 (FIG. 6).

Figure 7:
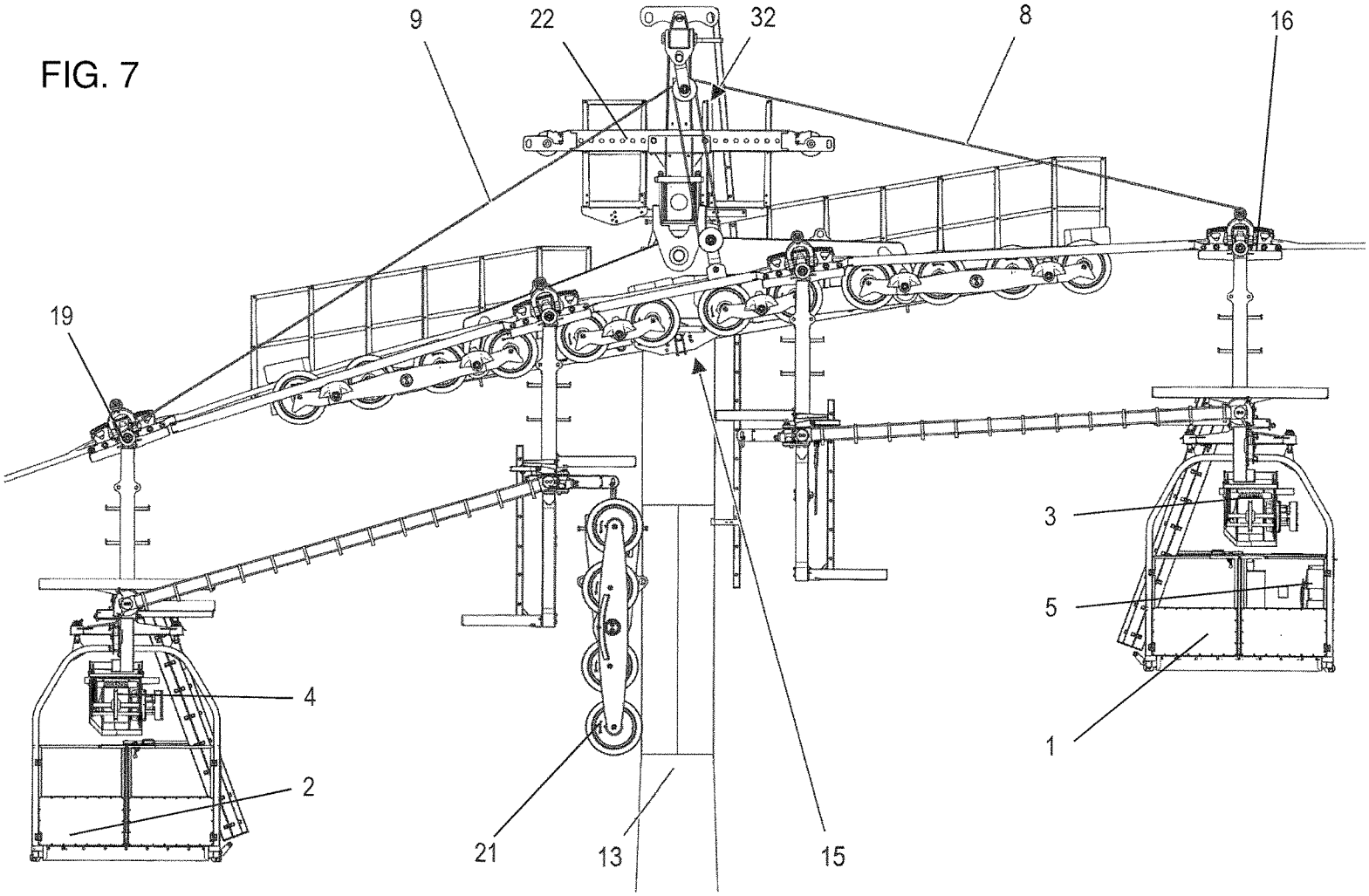
Figure 8:
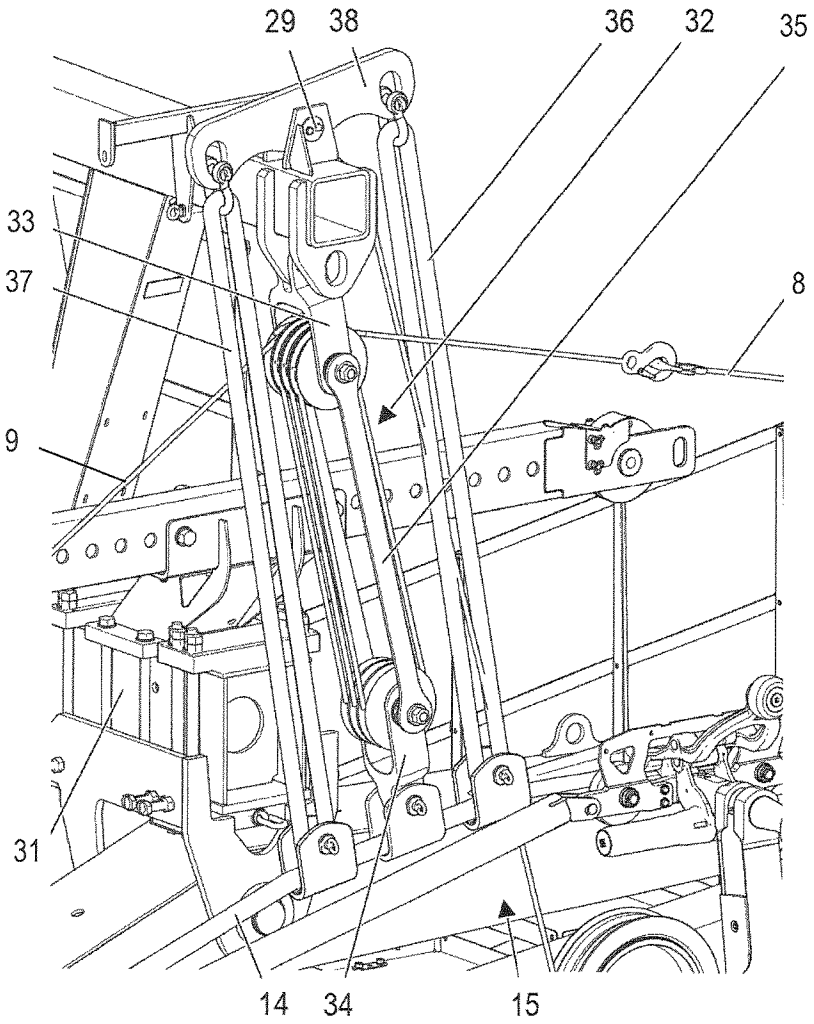

By means of a block and tackle 32 which is operated via the winch cables 8, 9, the conveying cable 14 with the replacing vehicle 10 coupled thereto is lifted from the roller set 15 being replaced (FIGS. 7 and 8). After lifting, the lower block tackle 33 is connected by means of retaining sheets 35 and bolts to the upper block tackle 34. In addition, the conveying cable is secured with round slings 36, 37 straight on a rocker 38, on which the deflection rollers 11, 12 were previously mounted, to the mounting 29. The winch cables 8, 9 are therefore free again.

Figure 9:
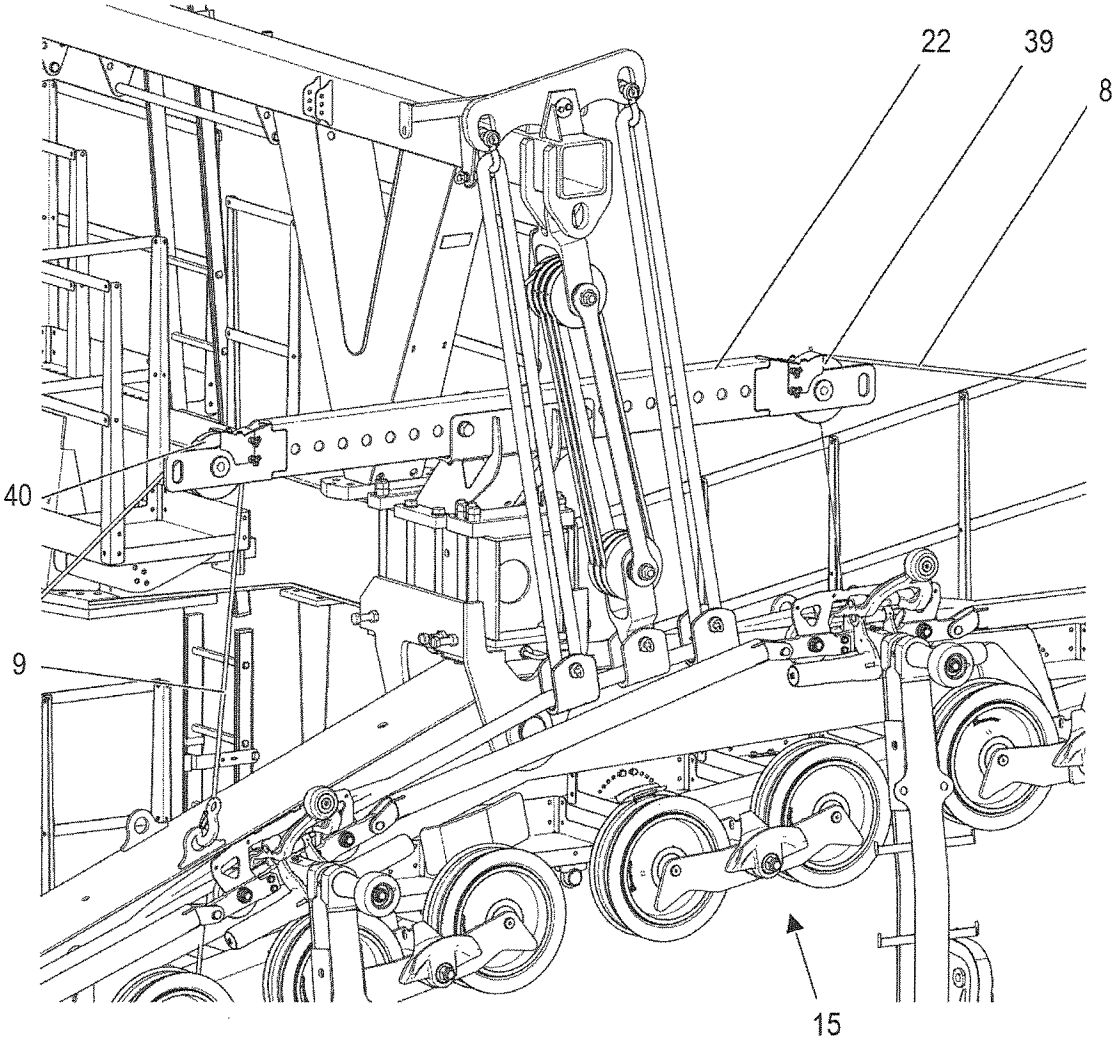
Figure 10:
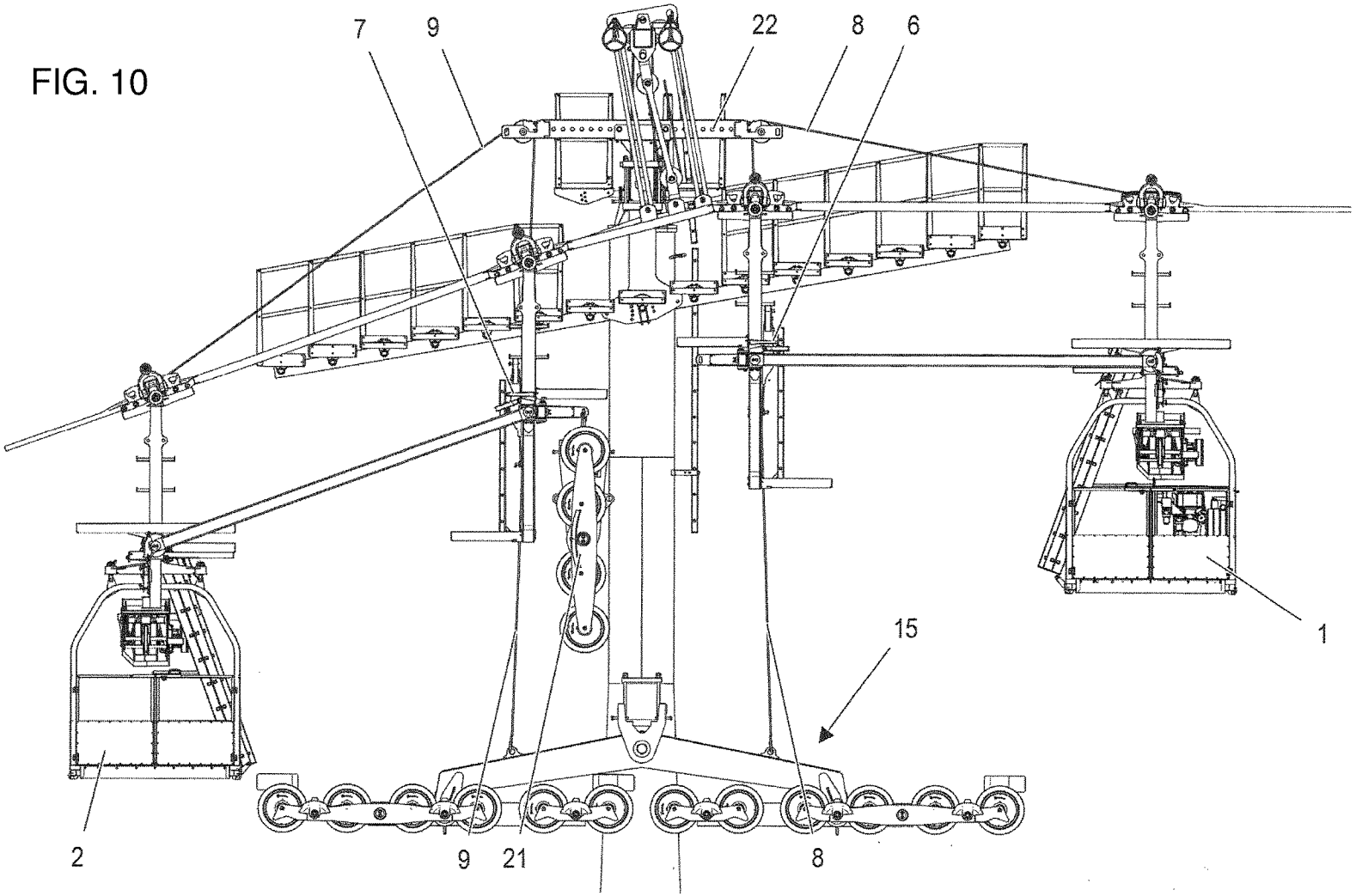

The hinged carriers 24 on the two suspension units 6, 7 are then moved into the vertical position and the swivel carriers 32 with the assembly roller set 21 mounted thereon, e.g. by means of hydraulic cylinders, pivoted backwards. The cable winch cables 8, 9 are placed on the assembly carrier 22 via deflection rollers 39, 40 and secured to the roller set 15 being replaced (FIG. 9).

Figure 11:
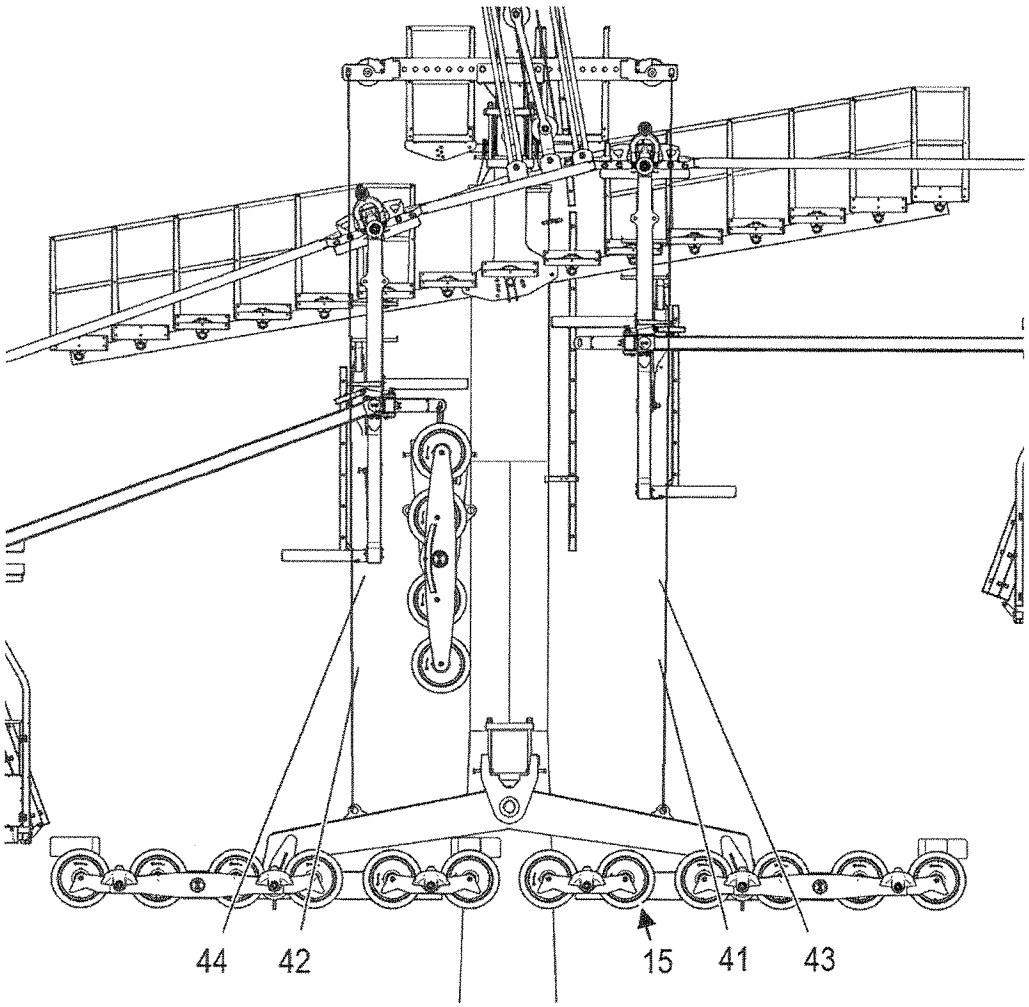

The old roller set 15 being replaced can now be removed and lowered in two stages by approx. 7 m, for example, by means of the cables 8, 9 and belt suspension units 41, 42. In the first stage, the roller set 15 is lowered by approx. 3.5 m with the help of the winch cables 8, 9 and secured to the assembly carrier 22 using the belt suspension units 41, 42 which each have a locating ring 43, 44 with carabiner hook in the center. In the second stage, the winch cables 8, 9 are released from the roller set 15 and secured to the center locating rings 43, 44 of the belt suspension unit 41, 42. The roller set 15 is subsequently lowered a further 3.5 m and then secured by the upper ends of the belt suspension unit 41, 42 to the assembly carrier 22, as shown in FIG. 11.

Figure 12:
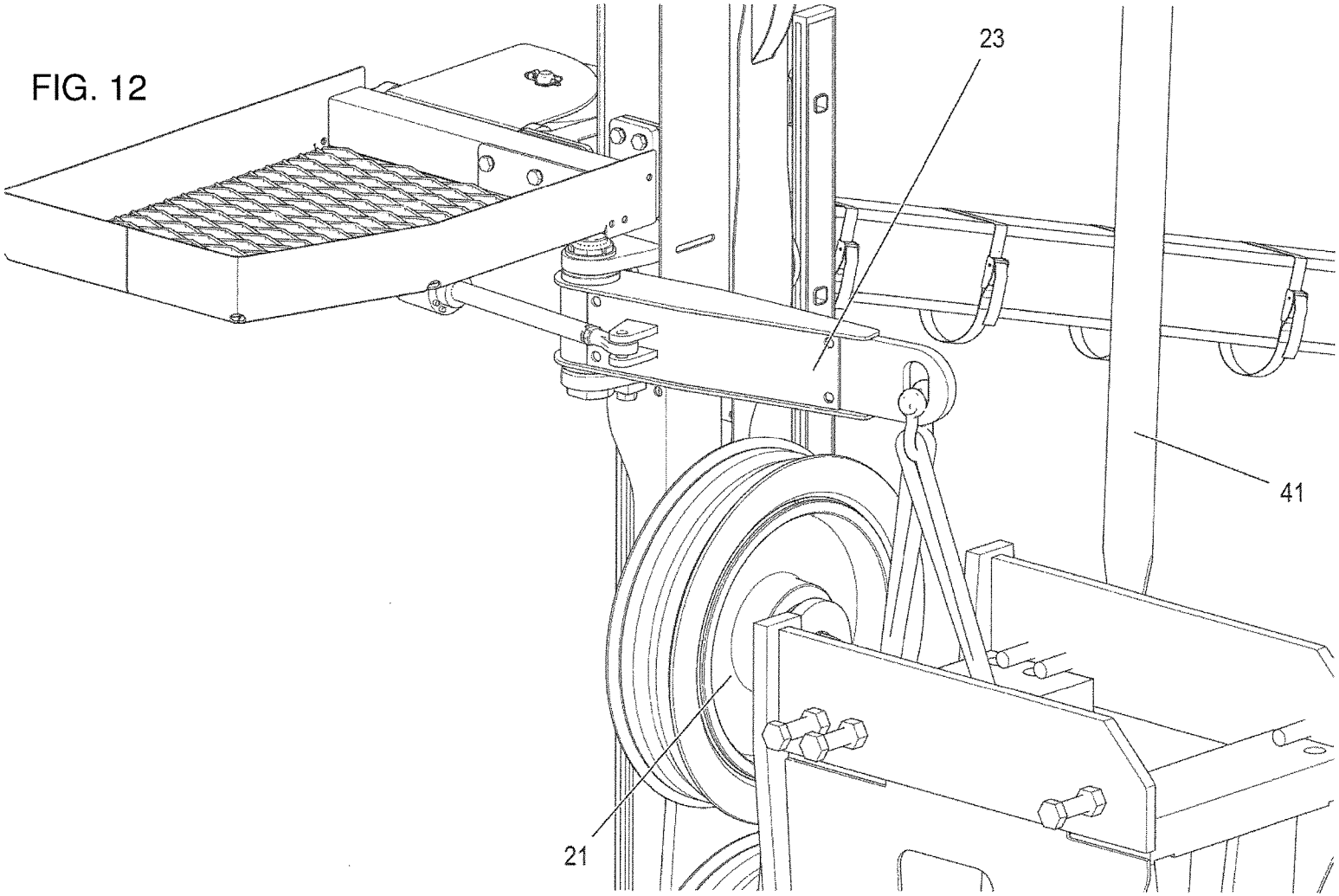
Figure 13:
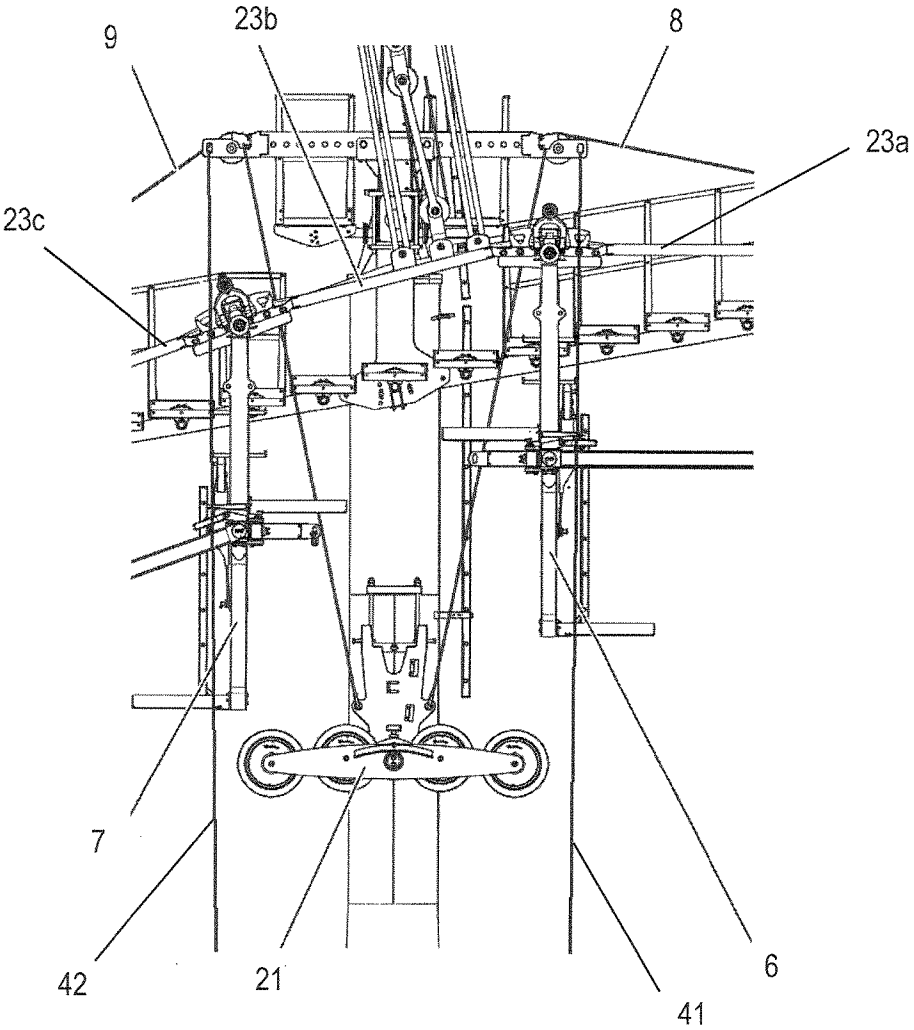

The assembly roller set 21 suspended from the swivel carrier 23 is then pivoted between the belt suspension units 41, 42 below the cross-head 31 (FIG. 12), drawn up by means of the cables 8, 9 (FIG. 13) and mounted on the cross-head 31. The conveying cable 14 can then be lowered using the block and tackle 32 to the assembly roller set 21, so that the cable car is ready for operation again.

Figure 14:
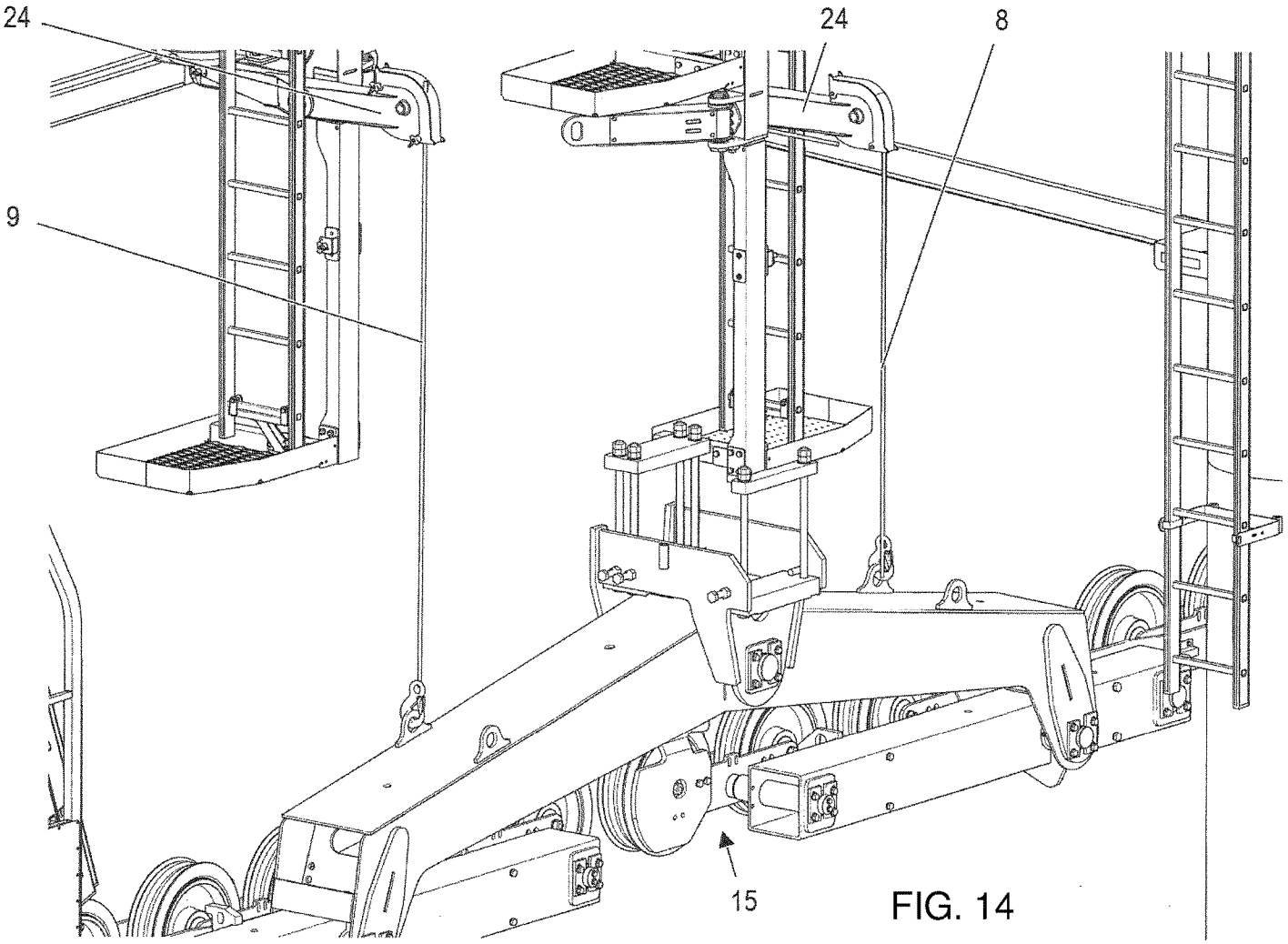

The old roller set 15 is then drawn up into the transport position with the help of the winch cables 8, 9 and the belt suspension units 41, 42 in two stages. The first stage involves the winch cables 8, 9 running via the deflection rollers 39, 40 on the assembly carrier 22 and being secured to the center locating rings 43, 44 of the belt suspension units 41, 42. The roller set can therefore be drawn up by approx. 3.5 m and secured using the center carabiner hooks of the belt suspension units 41, 42 to the assembly carrier 22. The second stage involves the winch cables 8, 9 being laid within the replacing vehicle 10 and over the cable pulleys 27 of the hinged carriers 24 and the hinged carriers 24 being pivoted into the lower position. The roller set 15 is then suspended on the winch cables 8, 9 and drawn up further into the transport position (FIG. 14).

Figure 15:
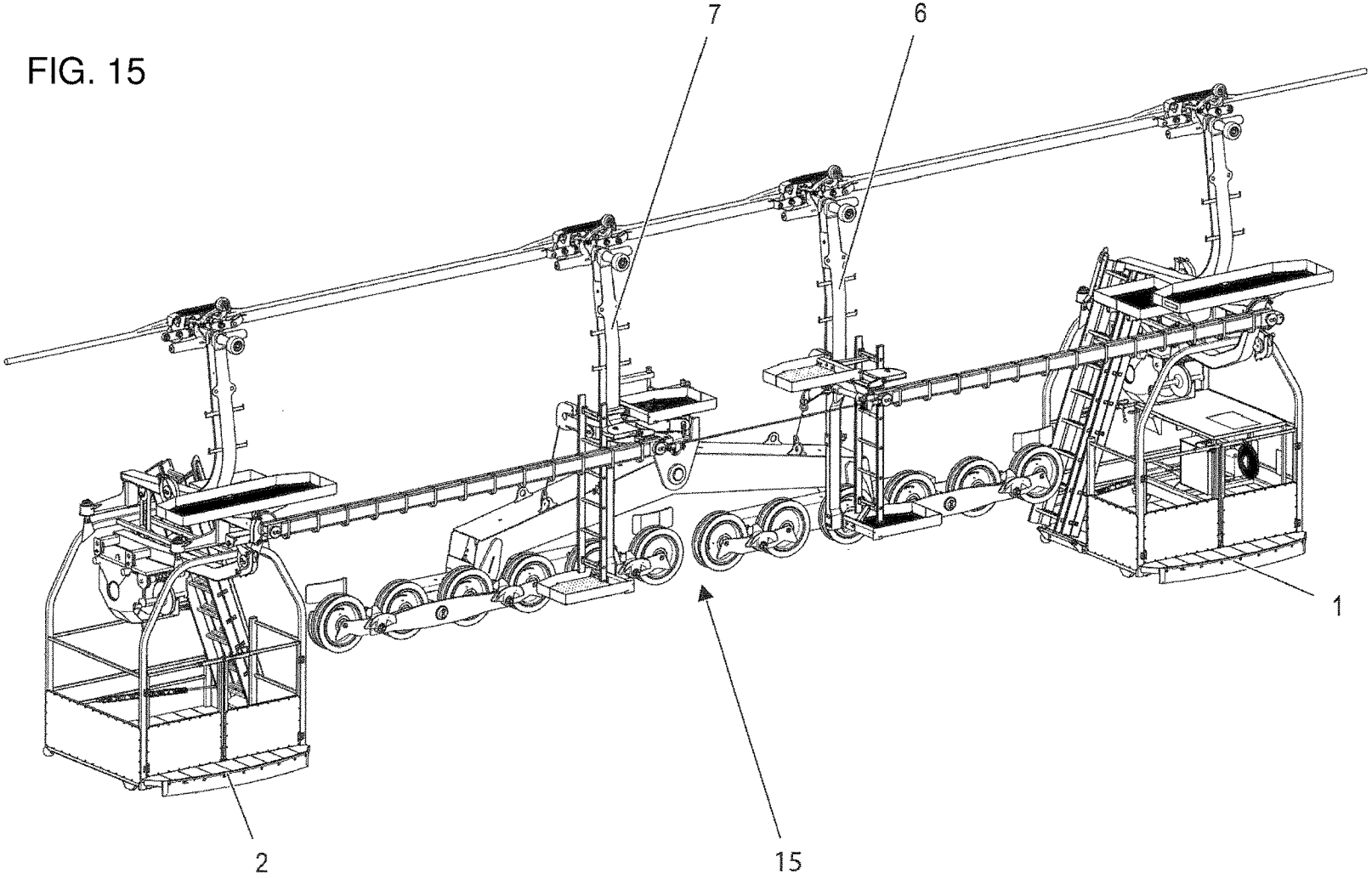
Figure 16:
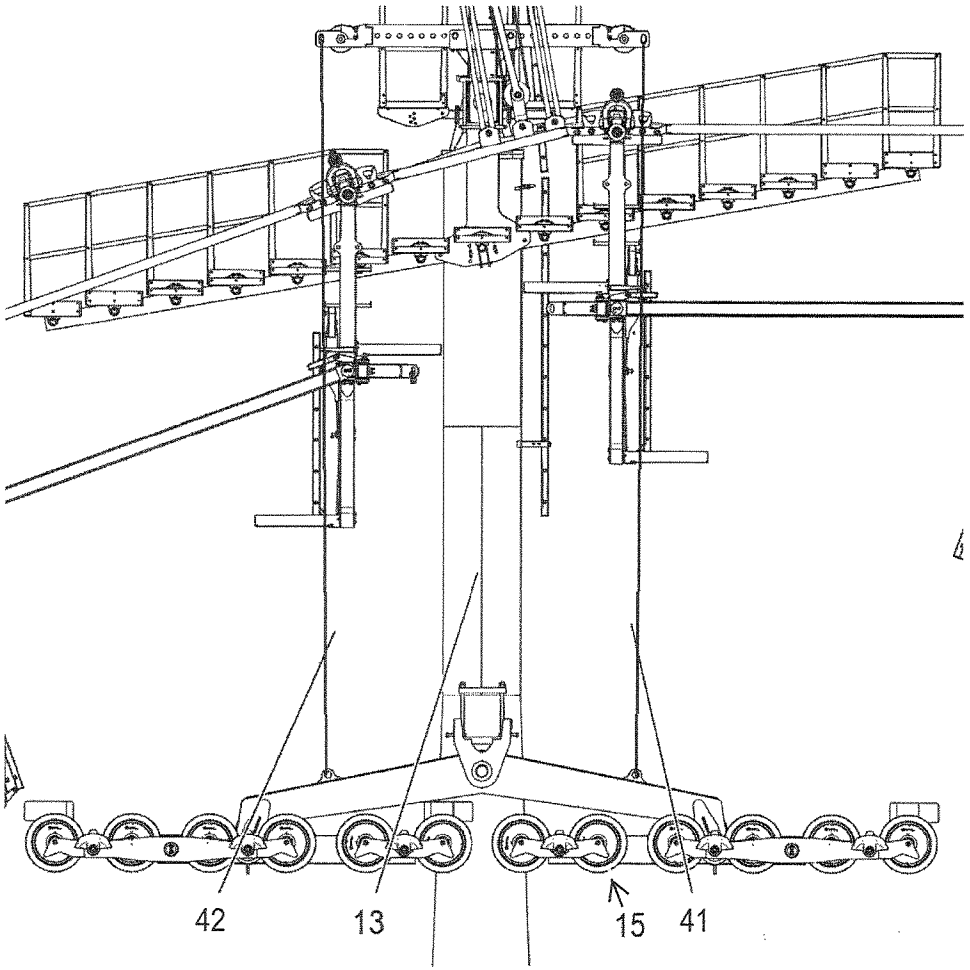
Figure 17:
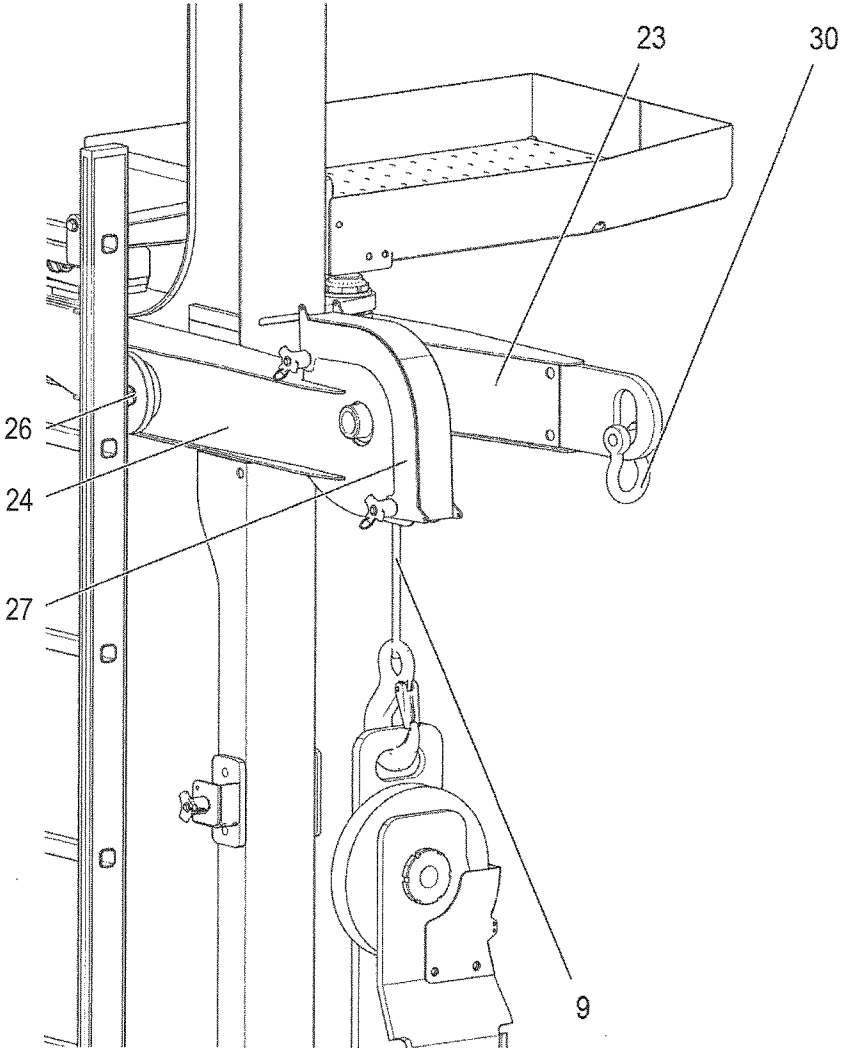

This is followed by the removal of the old roller set 15 to the lorry or storage site, as shown in FIG. 15, in that the replacing vehicle 10 travels with the old roller set 15 along the cable way above the lorry or storage site. At that point, the old roller set 15 is lowered to the ground using the cables 8, 9 and a new roller set 15 is drawn up.

With the normal cable car drive, the replacing vehicle 10 travels with the new roller set 15 to the pylon 13 concerned, as shown in FIG. 15. The roller set 15 hangs from the winch cables which are placed within the replacing vehicle 10 and run via the cable pulleys 27 of the hinged carriers 24. The subsequent lowering of the roller set 15 takes place in two stages as already described above by 7 m, for example, with the help of the winch cables 8, 9 and the belt suspension units 41, 42, until the roller set 15 is secured by the upper ends of the belt suspension units 41, 42 to the assembly carrier 22.

Using the block and tackle 32, which is again operated via the winch cables 8, 9, the conveying cable 14 is lifted from the assembly roller set 21 with the replacing vehicle 10, the lower block tackle 34 is connected with the retaining sheets 35 to the upper block tackle 33 and, in addition, the conveying cable 14 secured with round slings 36, 37 straight onto the rocker 38 of the mounting 29. The winch cables 8, 9 are therefore free again.

The hinged carriers 23 are pivoted into the vertical position and the swivel carriers 24 pivoted away. The cable winch cables 8, 9 run over the deflection rollers 39, 40 on the assembly carrier 22, so that the assembly roller set 21 can thereby be dismantled and lowered.

After the lowering, the assembly roller set 21 is transferred by means of the round sling 28 to the swivel carrier 23, which was pivoted inwards previously, so that the cable winch cables 8, 9 are free. Following this, the swivel carrier 23 is pivoted outwards again.

The raising of the new roller set 15 takes place with the help of the winch cables 8, 9 and the belt suspension units 41, 42, once again in two stages. In the first stage, the winch cables 8, 9 run over the deflection rollers 39, 40 on the assembly carrier 22 and are secured to the center locating rings 43, 44 of the belt suspension units 41, 42.

Following this, the roller set is drawn up by approx. 3.5 m and then secured to the assembly carrier 22 using the carabiner hooks of the center locating rings 43, 44 of the belt suspension units 41, 42. In the second stage, the winch cables 8, 9 are mounted straight on the roller set 15 again, the roller set 15 is raised up and mounted on the cross-head 31.

The conveying cable 14 is then lowered with the block and tackle 32 onto the newly mounted roller set 15, so that the cable car is once again ready for operation. The block and tackle 32 is then removed.

In order to dismantle the assembly carrier 22, the cable winch cables 8, 9 are laid over the two deflection pulleys 11, 12 now mounted once again on the mounting 29 or else the rocker 38 thereof, so that they can be used to dismantle and lower the assembly carrier 22. The assembly carrier 22 is then transferred by means of a round sling to the swivel carrier 23, so that the cable winch cables 8, 9 are free. The hinged carriers 24 are then moved into the horizontal position.

The cable winch cables 8, 9 are laid within the replacing vehicle 10 and the assembly roller set 21 and the assembly carrier 22 are secured to them.

The replacing vehicle 10 then travels with the assembly roller set 21 and the assembly carrier 22 along the cable way above the lorry or storage site. At this point, the assembly roller set 21 and the assembly carrier 22 are lowered to the ground and then the empty cable winch cables with the weights are drawn up again using the cable winches.

The replacing vehicle 10 is finally moved into the straight section of the terminal. The connection rods 23*a*, 23*b*, 23*c* have to be dismantled there. The individual vehicles 1, 2, 6, 7 can then be garaged at the terminal.

A great advantage of the device according to the invention and the method according to the invention is the short system downtime, i.e. roller sets can be replaced within a few hours. The main advantage is that the roller set can be replaced "in the air". Consequently, nothing need be placed on the ground beneath the pylon during assembly—something that is not possible or only possible with difficulty in densely built-up urban areas, over water, in steep terrain, etc.

This is made possible by, among other things:

the running of the replacing vehicle 10 on the same cable strand 14 on which the roller set 15 is being replaced;

the great distance between the winch vehicles 1, 2, so that the roller set 15 can be lowered a little therebetween;

the securing points, i.e. the hinged carriers 24 and the swivel carriers 23, in the center between the winch vehicles 1, 2, which can be solved by additional suspension units 6, 7, for example, but would also be workable with a special connection structure without additional suspension units 6, 7 between the winch vehicles 1, 2;

a corresponding cable run within the replacing vehicle 10, so that there is only a slight deflection of the vehicles 1, 2, 6, 7, even under load;

the additional assembly roller set 21, in order to move the cable way when the roller set 15 is dismantled, wherein it would also be possible, however, for a new roller set 15 to be carried along at the same time and for this to be immediately replaced for the old one on site without intermediate transportation;

the cable winch equipment can remain in the winch vehicles 1, 2, which simplifies handling and therefore reduces the assembly time;

the vehicles 1, 2, 6, 7 may be equipped with the same coupling grips 16, 17, 18, 19 as the standard vehicles, so that problem-free entry into the terminal and handling in the cable car station is possible.

The invention claimed is:

1. A device for replacing roller sets disposed on pylons of cable cars, the device comprising:

a replacing vehicle being moved along a cable of the cable car, said replacing vehicle having at least two winches with cables, by means of said replacing vehicle a roller set to be replaced can be lowered and a new roller set raised, said replacing vehicle further having grips and at least two interconnected vehicles which are connected to the cable by way of said grips; and connection rods, said interconnected vehicles are connected to each other at said grips by means of said connection rods.

2. The device according to claim 1, further comprising cable pulleys for said cables and disposed on said at least two interconnected vehicles.

3. The device according to claim 2, wherein said at least two interconnected vehicles are two of four interconnected vehicles including two outer vehicles and two inner vehicles, wherein said winches are disposed on said two outer vehicles and said cable pulleys for said cables are disposed on said two inner vehicles.

4. The device according to claim 3, further comprising further connection rods, two adjacent vehicles of said four interconnected vehicles are connected via said further connection rods which are connected to said interconnected vehicles and spaced apart from said grips.

5. The device according to claim 4, wherein said two outer vehicles are connected to an adjacent inner vehicle in each case via said further connection rods.

6. The device according to claim 2, further comprising hinged carriers, said cable pulleys are disposed on said hinged carriers mounted in pivotable fashion on said interconnected vehicles about a horizontal axis.

7. The device according to claim 1, further comprising:

rocker deflection rollers for said cables; and a rocker mounted on the pylon, said rocker deflection rollers are mounted on said rocker in a removable fashion.

8. The device according to claim 7, further comprising round slings disposed on said rocker, at which said cable is suspended in a detached state.

9. The device according to claim 1, further comprising an assembly roller set which can be temporarily mounted on the pylon instead of the roller set.

10. The device according to claim 9, further comprising a block and tackle mounted on the pylon for lifting the cable for the cable cars off or lowering the cable for the cable cars onto the roller set or said assembly roller set.

11. The device according to claim 1, further comprising pivotable swivel carries disposed about a vertical axis on at least two of said interconnected vehicles for loads that can be suspended therefrom.

12. The device according to claim 1, further comprising:

two deflection rollers; and an assembly carrier secured to the pylon, on said assembly carrier said two deflection rollers for said cables are mounted.

13. The device according to claim 1, further comprising deflection rollers disposed at said grips of said interconnected vehicles.

14. A method of replacing roller sets on pylons of cable car systems, which comprises the steps of:

driving a replacing vehicle to a pylon;

raising a cable running on an old roller set from the old roller set using the replacing vehicle;

removing the old roller set;

mounting a temporary assembly roller set temporarily on the pylon and the cable is placed onto the temporary assembly roller set; and moving the replacing vehicle along the cable to another position whereby a new roller set is moved with the replacing vehicle to the pylon and the cable running on the temporary assembly roller set is raised from the temporary assembly roller set using the replacing vehicle and the temporary assembly roller set is subsequently replaced with the new roller set.

* * * * *